US006430894B1

(12) United States Patent
Chae et al.

(10) Patent No.: US 6,430,894 B1
(45) Date of Patent: Aug. 13, 2002

(54) SEALED DOUBLE GLAZING UNIT

(75) Inventors: Soo-Choel Chae, Incheon; Jin Kim; Byung-Seok Yu, both of Kyunggi-do; Dong-Il Shin; Hee-Sook Yang, both of Seoul, all of (KR)

(73) Assignee: Hankuk Glass Industries Inc., Seoul (KR)

( * ) Notice: Subject to any disclaimer, the term of this patent is extended or adjusted under 35 U.S.C. 154(b) by 0 days.

(21) Appl. No.: 09/581,249

(22) PCT Filed: Dec. 24, 1998

(86) PCT No.: PCT/KR98/00459

§ 371 (c)(1),
(2), (4) Date: Jun. 26, 2000

(87) PCT Pub. No.: WO99/34082

PCT Pub. Date: Jul. 8, 1999

(30) Foreign Application Priority Data

Dec. 26, 1997 (KR) ..... 97-74256

(51) Int. Cl.[7] ..... E04C 2/02

(52) U.S. Cl. ..... 52/786.1; 52/786.13; 52/788.1; 52/204.593; 52/235

(58) Field of Search ..... 52/786.1, 786.13, 52/788.1, 204.593, 235, 204.63, 208

(56) References Cited

U.S. PATENT DOCUMENTS

| | | | | | |
|---|---|---|---|---|---|
| 4,581,868 | A | * | 4/1986 | McCann | 52/398 |
| 4,680,206 | A | * | 7/1987 | Yoxon et al. | 528/34 |
| 4,817,585 | A | * | 4/1989 | Craver | 126/200 |
| 4,893,443 | A | * | 1/1990 | Haber | 52/208 |
| 5,455,085 | A | * | 10/1995 | Miller | 428/34 |
| 5,497,586 | A | * | 3/1996 | Dodd et al. | 52/172 |
| 5,540,514 | A | * | 7/1996 | Demars et al. | 403/388 |
| 6,052,965 | A | * | 4/2000 | Florentin et al. | 52/786.13 |
| 6,105,319 | A | * | 8/2000 | Brunt | 52/204.593 |
| 6,138,434 | A | * | 10/2000 | Demars et al. | 52/786.13 |
| 6,158,177 | A | * | 12/2000 | Blobaum | 52/208 |
| 274 | A | * | 4/1837 | Elmer et al. | 52/235 |

FOREIGN PATENT DOCUMENTS

| | | | |
|---|---|---|---|
| EP | 0686751 | 12/1995 | E06B/3/54 |
| JP | 9177442 | 7/1997 | E06B/3/66 |
| KR | 1993-009113 | 9/1993 | E06B/0/66 |

* cited by examiner

*Primary Examiner*—Carl D. Friedman
*Assistant Examiner*—Phi Dieu Tran A
(74) *Attorney, Agent, or Firm*—Jacobson Holman, PLLC

(57) ABSTRACT

A sealed double glazing unit having an outer pane with a countersunk hole punched in a corner thereof, and an inner pane with a hole punched in a corner thereof, opposed to the countersunk hole in the outer pane. A generally cylindrical liner is inserted into the countersunk hole in the outer pane, a bottom of the liner extending into, without passing through, the countersunk hole in the outer pane. A glazing unit is secured to a supporting member by a fixing member which is fixed through the liner, and a sealing member engages the holes in the inner and outer panes. This sealing member includes a guide ring having the same diameter as the diameter of the bottom of the liner, with a front end of the guide ring extending into the countersunk hole and abutting against the bottom of the liner. The sealing member also includes a ring-shaped boss concentric with and encircling the guide ring, the ring-shaped boss having an inner diameter that is larger than an outer diameter of the guide ring such that a space is formed between the guide ring and the boss. This space is bridged by a plurality of connecting parts extending between the outer diameter of the guide ring and the inner diameter of the ring-shaped boss.

9 Claims, 11 Drawing Sheets

SEALED DOUBLE GLAZING UNIT

TECHNICAL FIELD

The present invention relates to a sealed double glazing unit used to construct the outer wall of a building with glass panes, and more particularly to a sealed double glazing unit with a sealing member for accomplishing heat insulation and soundproof properties by sealing the perimeter of fixing holes used to mount glass panes.

BACKGROUND ART

The technology has been used which constructs glass wall by fixing glass panes to a building wall by means of fixing means to obtain the aesthetic appearance and good transparency. But, there occurs a problem that to facilitate the execution for fixing the glass panes as structural elements of the glass wall to the building, employing a single glass pane deteriorates heat insulation and soundproof properties.

To solve the above-mentioned problem, the technology of constructing glass wall with double-glass panes instead of single-glass panes has been disclosed in Korean Patent Publication No. 93-9113 (Glazing units and glass assemblies with an array of a plurality of glazing units) and Japanese Laid-open patent No. Pyung 9-177442 (Multi-layer glass and supporting structure for the multi-layer glass).

The glazing units disclosed in the Korean patent publication No. 93-9113 are sealed double glazing units and comprises a fixing assembly consisting of a fixing bolt, a bush and a boss and fixing the glazing units to the plate member at least one fixing position, wherein the fixing assembly comprising a bush and a boss is attached to one of the glass panes in a manner which permits the unit to flex under wind load without impairing the seal of the unit, and at both sides of a boss located between an outer pane and an inner pane of the unit, an rubber ring is provided. But, to seal the holes punched in an outer pane and an inner pane of the unit, since a lot of processes are required for assembling the fixing elements of the fixing assembly, such as a fixing bolt, a bush, a boss and rubber rings, the above-mentioned invention is inappropriate to the process for mass producing, thereby decreasing the productivity, and since the fixing assembly is fixed to the plate member of a building while it supports any one part of an outer pane and an inner pane of the unit, and thus the safety is deteriorated.

Meanwhile, double glazing units and the supporting structure for the double glazing units disclosed in the Japanese Laid-open patent relates to sealing the holes punched in an outer pane and an inner pane of the unit separately from the fixing assembly of the unit to solve the problem of the above-mentioned unit, wherein at an outer pane, a first fixing hole is provided, a second fixing hole is provided at the corresponding position to that of a first fixing hole, a second spacer having a larger diameter than that of the air layer side of these fixing holes, is arranged around the holes, a glass liner which conforms the shape of inner peripheral surface of the first fixing hole is arranged projecting more than 3 mm toward the air layer side, and a second sealing is conducted within the space defined by the outer pane, the inner pane, the second spacer and the projecting part of the glass liner.

But, the fabricating process through automatic production line for the double glazing units comprises the steps of: washing an outer pane and an inner pane of double glazing units; preparing a space for a hole in the outer pane, for inserting a liner into the hole therein, while pre-washed outer pane is ready; inserting the liner into the hole; attaching a tape for fixing the liner to the outer pane; positioning the outer pane at the original position; inserting an auxiliary tool for locating a spacer with respect to the hole; attaching the spacer to an inner peripheral surface of the outer pane by the auxiliary tool; separating the auxiliary tool; connecting the washed inner pane. It is necessary to reconstruct the existing facilities in the automatic production line for the sake of the liner inserting step and the tape attaching step, with the result that expensive automatic robots are added to the line, thereby deteriorating the productivity, and it is also necessary to remove the reconstructed facilities when fabricating the existing double glazing units. Also, there is a problem that adding the inserting and separating steps of the auxiliary tool for attaching the spacer causes the deterioration of the productivity.

It is an object of the present invention to provide a sealed double glazing unit comprising a sealing member having simple structure, for sealing the holes in an outer pane and an inner pane of the unit while maintaining the separate distance stable.

Another object of the present invention is to provide a sealed double glazing unit for facilitating the filling of sealing compound.

DISCLOSURE OF INVENTION

According to the present invention, there is provided a sealed double glazing unit comprising: an outer pane having a countersunk hole punched in a corner thereof; an inner pane having a hole punched in a corner thereof and opposed to the hole in an outer pane and having larger diameter than that of the hole punched in the outer pane; a liner inserted into the countersunk hole in the outer pane; a fixing member fixed through the liner to a supporting member of the wall body of a building; a sealing member for sealing holes in the outer pane. and the inner pane together with a sealing compound; and a supporting member having a hole through which a bolt passes, and fastened with a nut.

In one embodiment, the sealing member comprises: a guide ring having the same diameter as that of the liner, outer peripheral surface of the front end of the guide ring which extends to approach the bottom of the liner fitted into the countersunk hole in the outer pane fitted with the inner peripheral surface of the hole in the outer pane; a plurality of connecting parts which extend outwardly from at least three positions in the middle of the outer peripheral surface of the guide ring, for preparing a sealing space; a ring-shaped boss formed integrally with the guide ring and the connecting parts, two sides of the ring-shaped boss attached to the inner surfaces of the outer pane and the inner pane with butyl, where in the sealing space defined by the inner pane, the outer pane and the sealing member is filled with sealing compound.

In another embodiment, the bottom of a liner inserted into a countersunk hole in an outer pane extends to the vicinity of the hole in an inner pane, and a sealing member has a boss and a plurality of connecting parts integrally formed without a guide ring.

In yet another embodiment, the bottom of a liner inserted into a countersunk hole in an outer pane extends to the vicinity of the hole in an inner pane, and the is width of a guide ring is the same as those of the connecting parts and is smaller than that of the space between the outer pane and the inner pane.

In still another embodiment, a boss and a guide ring of a sealing member are formed separate, and a bellows-shaped plate is inserted therebetween.

In further another embodiment, for the sake of a moisture-tight and air-tight seals, a pair of O-rings is arranged between both sides of the boss of the sealing member and the outer and the inner panes, one O-ring between the liner and the guide ring of the sealing member, and another O-ring between the socket of the fixing member and the hemisphere part at the top of the fixing bolt.

BEST MODE FOR CARRYING OUT THE INVENTION

The preferred embodiments according to the invention are described in detail with reference to the accompanying drawings below.

Figure 1:
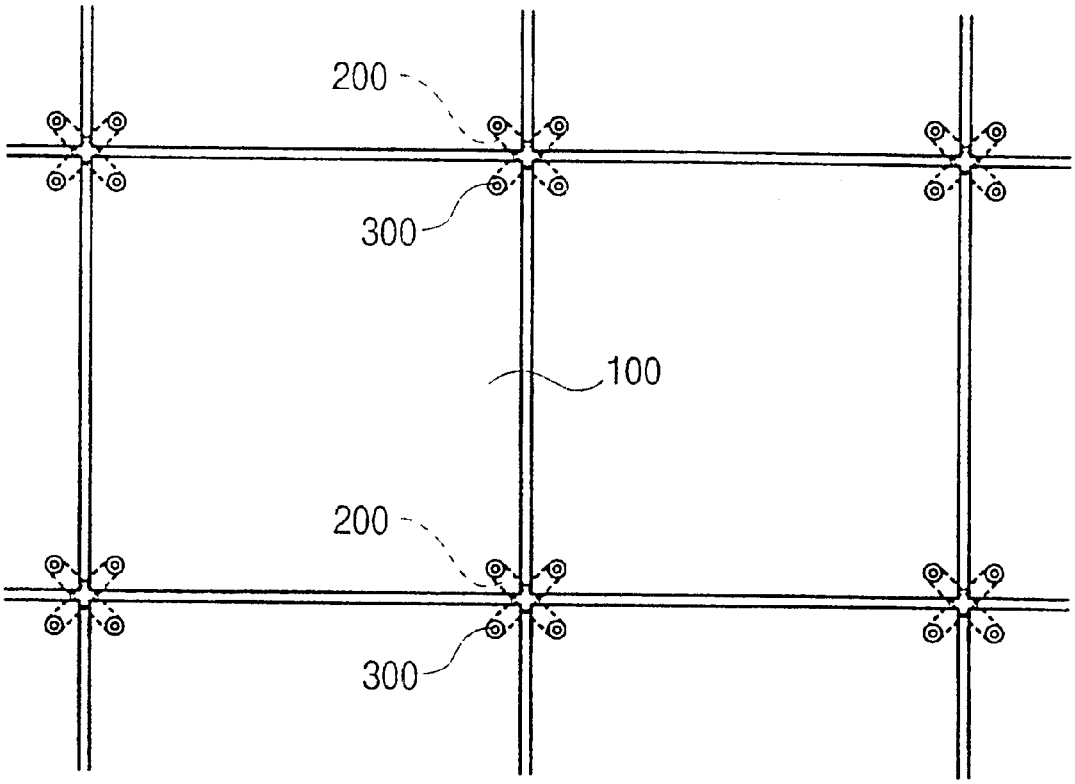
FIG. 1 is an elevation of part of the outside of a glass wall assembly constructed using sealed double glazing units according to the invention.
Figure 2:
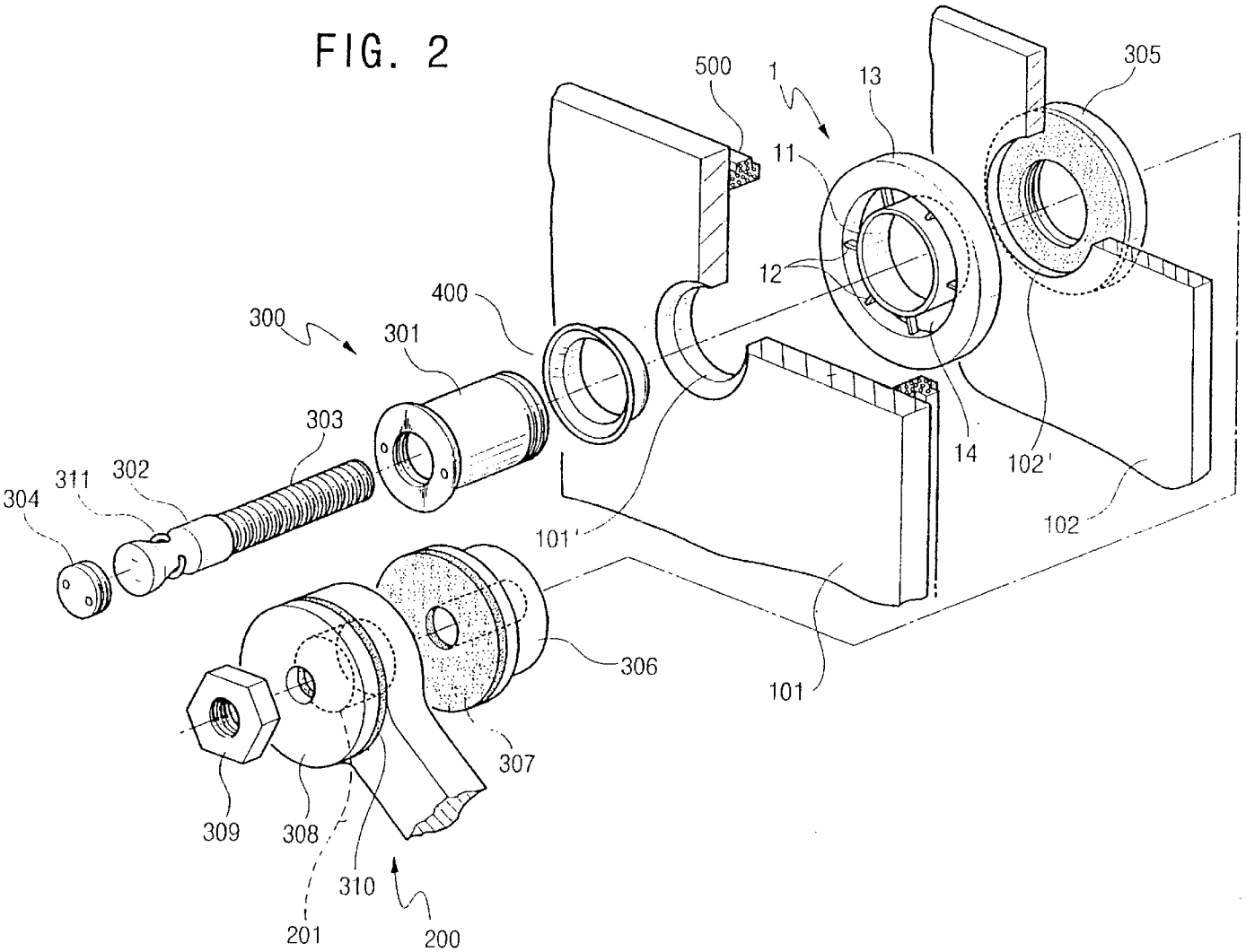
FIG. 2 is an exploded perspective view showing a double glazing unit according to the invention and a fixing member for fixing the double glazing unit.

As shown in FIG. 1, in order to construct glass wall assembly from double glazing units, the fixing holes are punched at 4 to 8 positions in double glazing units, and in an embodiment according to the invention, the constitution of mounting double glazing units by using fixing holes at 4 positions therein is illustrated.

A countersunk hole 101' and a hole 102' are punched as fixing holes at the corners of an outer pane 101 and an inner pane 102, respectively, each fixing member 300 is inserted into the holes 101', 102', and the fixing member 300 is fixed to a cross-shaped supporting member 200 to construct glass wall assemblies 100.

The fixing member comprises: a socket 301 inserted into a liner 400 which is fitted with a countersunk hole 101' in the outer pane 101; a bolt 303 having a hemisphere-shaped head 302 formed integrally with the bolt 303 at the top thereof, which head is inserted into the socket 301 and has flexibility; a nut 305 fastened with the thread part of the socket 301 passing through the hole 102' in the inner pane 102; a rubber 307 and a bush 306 through which the bolt 303 passes, for providing clearance; a rubber plate 310 and a washer 308 through which the end portion of the bolt 303 passes; a nut 309 fastened with the end portion of the bolt 303, wherein around the constricted throat portion, a rubber ring 311 is fitted for the sake of the yielding effect.

As set forth above, around the holes 101',102' in an outer pane 101 and an inner pane 102 of double glazing unit, into which the fixing member 300 is inserted, the sealing member 1 according to the invention is provided to reinforce heal insulation and supporting properties.

An outer pane 101 which is 6–19 mm in thickness and an inner pane 102 which is 5–15 mm, between which a sealing member 1 according to the invention is arranged, have a moisture-tight and air-tight seals and maintain proper clearance by silicon compound 600 and a sealing member 500 of a aluminum spacer, around the periphery of which hygroscopic compound is applied to obtain heat insulation and soundproof effect, the countersunk hole 100' is punched at the corner of the outer pane 101, the hole 102' which faces the hole 101' of the outer pane 101 and has 8–10 mm larger diameter than that of the hole 101' in the outer pane 101 is punched at the corner of the inner pane 102, the liner 400 which is 2–3 mm shorter in length than the width of the outer pane 101 is inserted into the hole 101' not to pass through the hole 101', and a fixing member 300 to be fastened to the sealing member 200 of the building wall is inserted into and passes through the liner 400.

Figure 3:
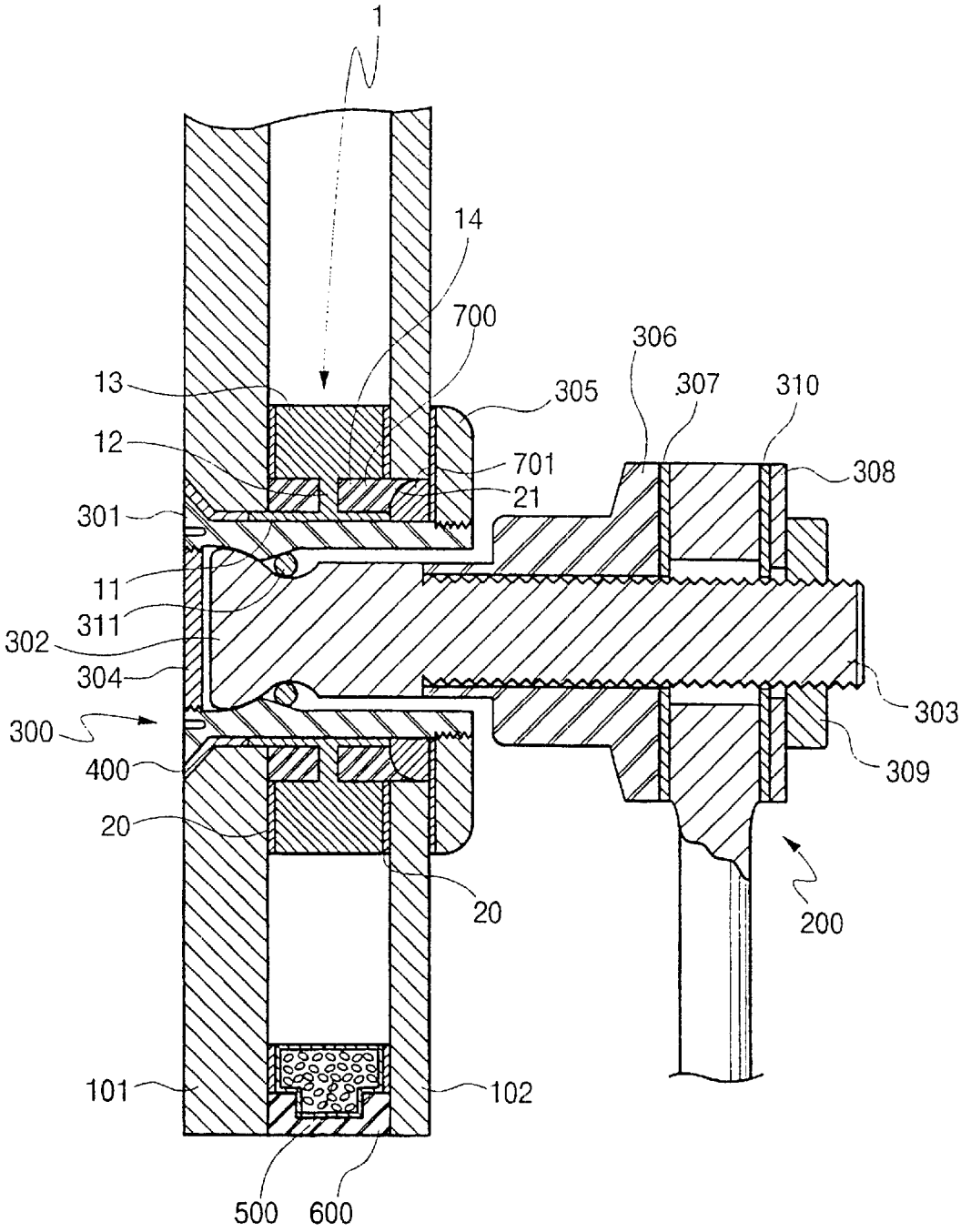
FIG. 3 is a partially sectional view showing in detail a fixing member for fixing to a supporting member one form of sealed double glazing unit according to the invention.
Figure 4:
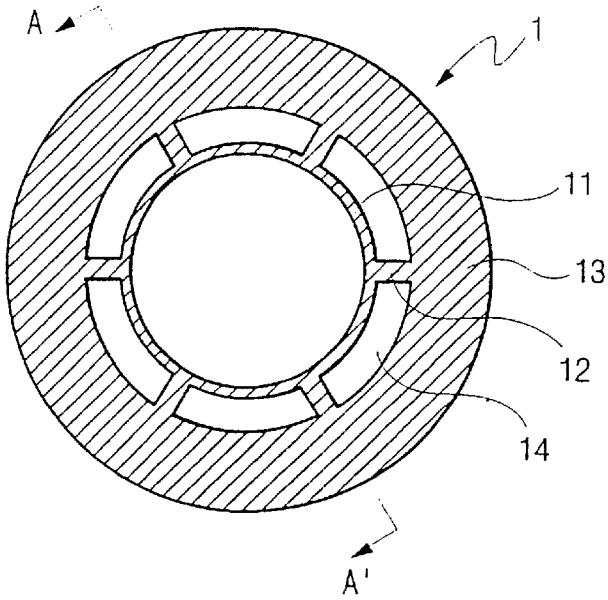
FIG. 4 is a sectional view showing a sealing member for sealing sealed double glazing unit according to the invention.
Figure 5:
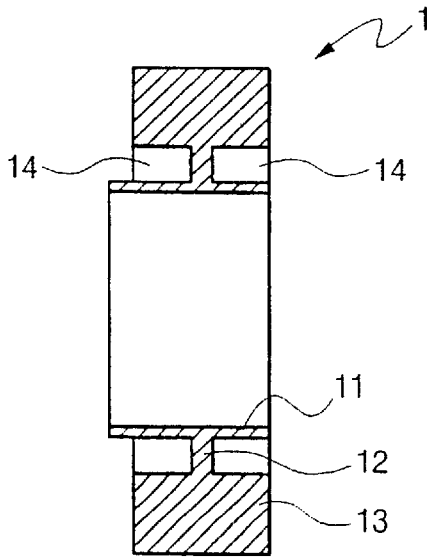
FIG. 5 is a sectional view taken from the line A–A' of FIG. 4.

As shown in FIG. 3 to FIG. 5, the sealing member 1 according to the invent ion comprises: a guide ring 11 having the same diameter as the diameter of the liner 400, outer peripheral surface of a front end of the guide ring 11 which extends to approach the bottom of the liner 400 fitted into the countersunk hole 101' in the outer pane 101 is fitted with the inner peripheral surface of the hole 101' in the outer pane 101; a plurality of connecting parts 12 which extend outwardly from at least three positions in the middle of the outer peripheral surface of the guide ring 11, for preparing the sealing space 14; a ring-shaped boss formed integrally with the guide ring 11 and the connecting parts 12, two sides of the ring-shaped boss attached to the inner surfaces of an outer pane 101 and inner pane 102 with butyl.

The connecting parts 12 are formed from one or more positions in the least thickness to be required for the support while providing a sealing space 14, the connecting parts 12 bridging the guide ring 11 and the boss 13 of the sealing member 1, thereby facilitating to apply sealing compound 700 to seal the sealing space 14.

Further, the sealing member 1 is integrally formed with metal or reinforced synthetic resin materials, is preferably made of synthetic resin material in consideration of the productivity, the fabricating cost and weight or the like, and may be made of metallic materials, such as aluminum or stainless steel when requiring larger double glazing units and the reinforcement of the supporting force. The first sealing of the sealing member 1 is described in detail below.

When fitting the guide ring 11 with the hole 101' in the outer pane 101 after applying butyl to both side surfaces of the boss 13, first, one side surface of the boss 13 is attached to the inner surface of the outer pane 101 and thus is positioned, and then the other side surface of the boss 13 is also attached around the hole 102' in the inner pane 102 and to the inner surface of the inner pane 102.

At this time, when sealing space 21 is filled with typical silicon sealing compound 700, the sealing compound 700 is distributed uniformly in the sealing space 14 while incoming into the space 14, and then the filling process is finished when the sealing space 21 is filled up with the sealing compound 700. By this, since the sealing compound 700 does not soak out from the sealing space 14, an additional cutting process is unnecessary. The second finishing sealing process is conducted by applying sealing compound 701 after inserting the socket 301 into the liner 400 fitted with the hole 101' in the outer pane 101, and thus the moisture-tight and air-tight properties are improved.

Figure 6:
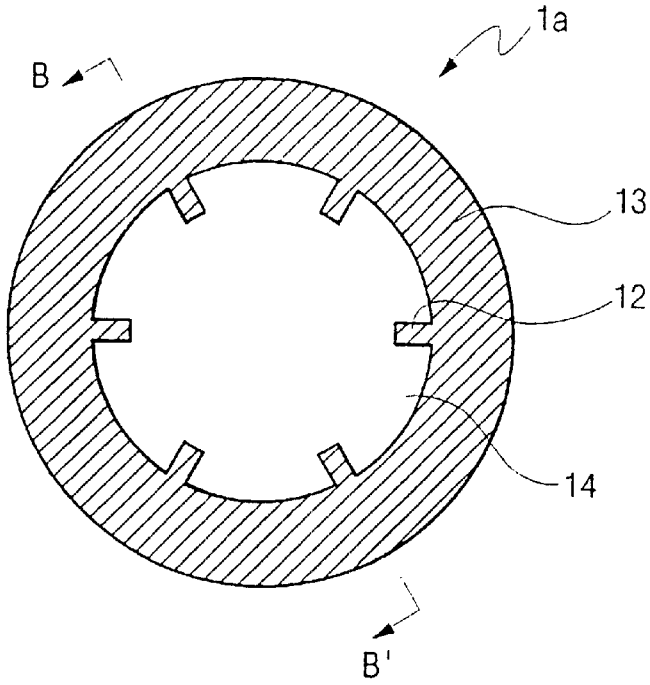
FIG. 6 is a sectional view showing another embodiment of a sealing member for sealing sealed double glazing unit according to the invention.
Figure 7:
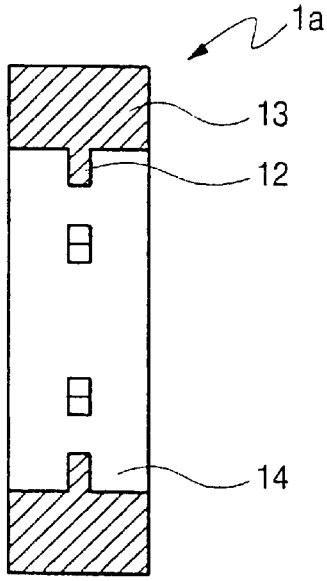
FIG. 7 is a sectional view taken from the line B–B' of FIG. 6.
Figure 8:
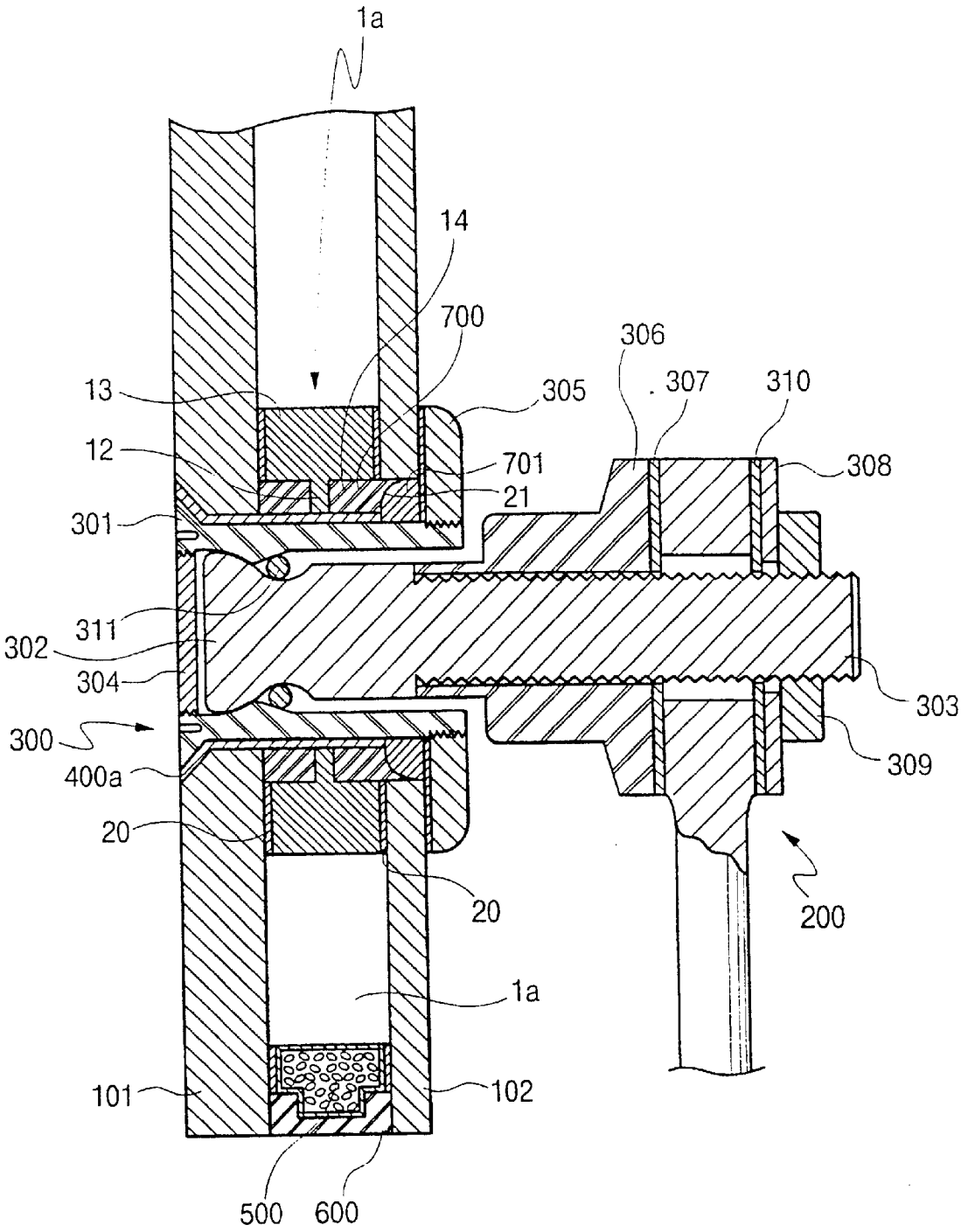
FIG. 8 is a partially sectional view showing in detail a fixing member for fixing to a supporting member another form of an sealed double glazing unit using the sealing member as shown in FIG. 6, according to the invention.

Also, as shown in FIG. 6 to FIG. 8; in another embodiment of the invention, the bottom of the liner 400 inserted into the countersunk hole 101' in the outer pane 101 to protect the outer pane 101 during the coupling of the fixing member 300 extends approximately to the hole 102' in the inner pane 102, the sealing member 1*a* have a boss 13 and a connecting parts 12 integrally formed without a guide ring 11 in the sealing member 1, and the free ends of the connecting parts 12 contact with the outer peripheral surface of the liner 400*a*, thereby forming the sealing space 14.

Figure 9:
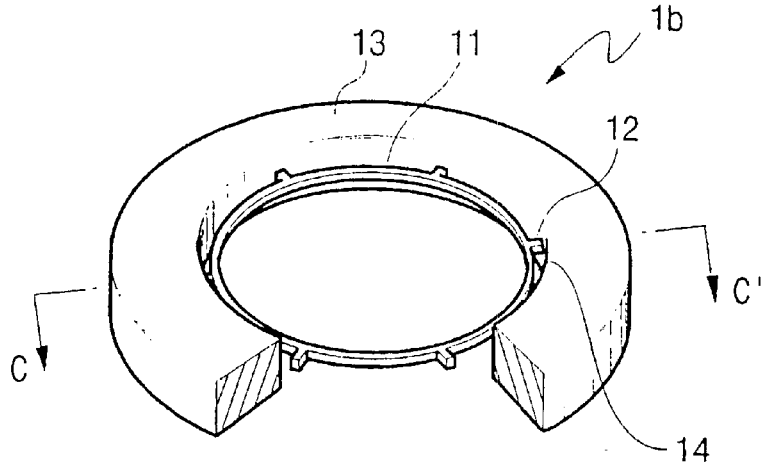
FIG. 9 is a partially cutaway view showing a boss of the double glazing unit according to another embodiment of the invention.
Figure 10:
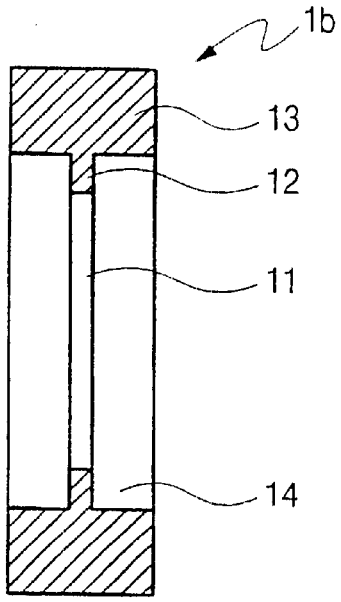
FIG. 10 is a sectional view taken from the line C–C' of FIG. 9
Figure 11:
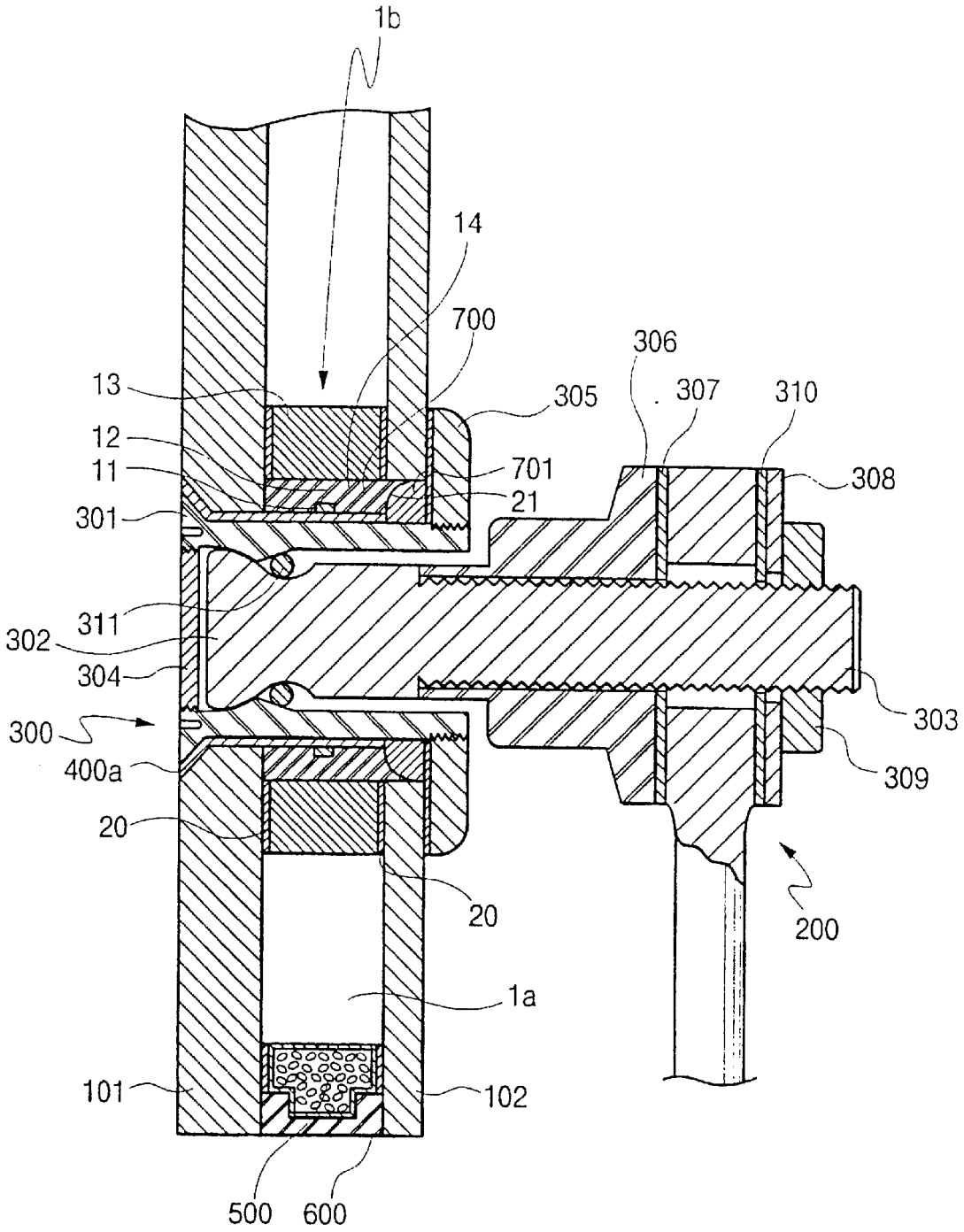
FIG. 11 is a partially sectional view showing in detail a fixing member for fixing to a supporting member another form of the sealed double glazing unit using the sealing member as shown in FIG. 10, according to the invention.

Next, as shown in FIG. 9 to FIG. 11, in yet another embodiment of the invention, the width of a guide ring 11 is the same as those of connecting parts 12, the bottom of the liner 400*a* inserted into the countersunk hole 101' in the outer pane 101 extends approximately to the hole 102' in the inner pane 102, and inner peripheral surface of the guide ring 11 contacts with the outer peripheral surface of the liner 400*a*.

Figure 12:
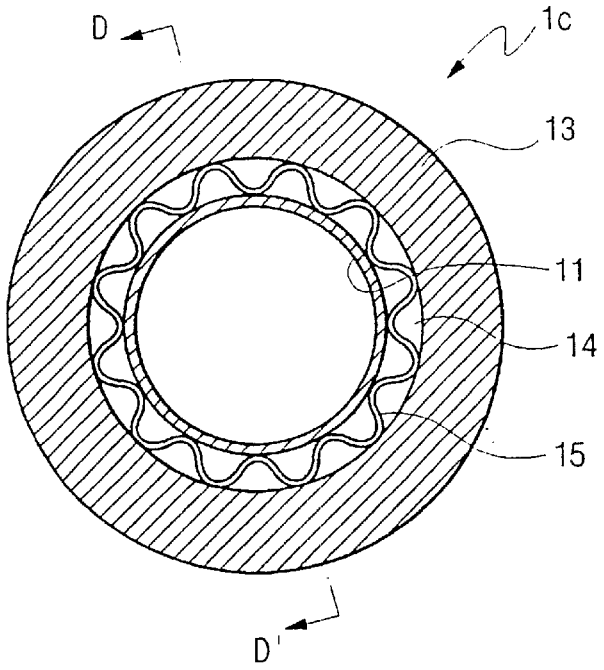
FIG. 12 is a sectional view showing yet another embodiment of a sealing member for sealing the sealed double glazing unit according to the invention.
Figure 13:
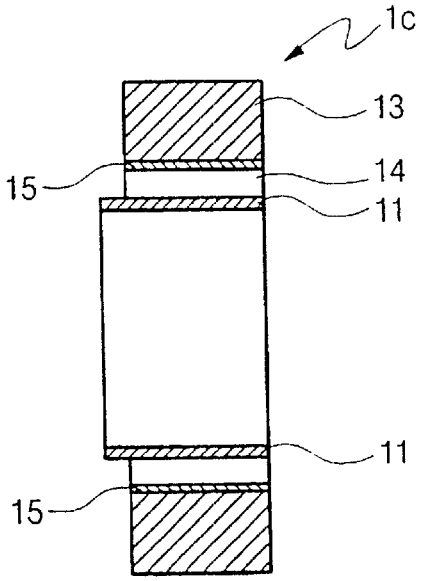
FIG. 13 is a sectional view taken from the line D–D' of FIG. 12.
Figure 14:
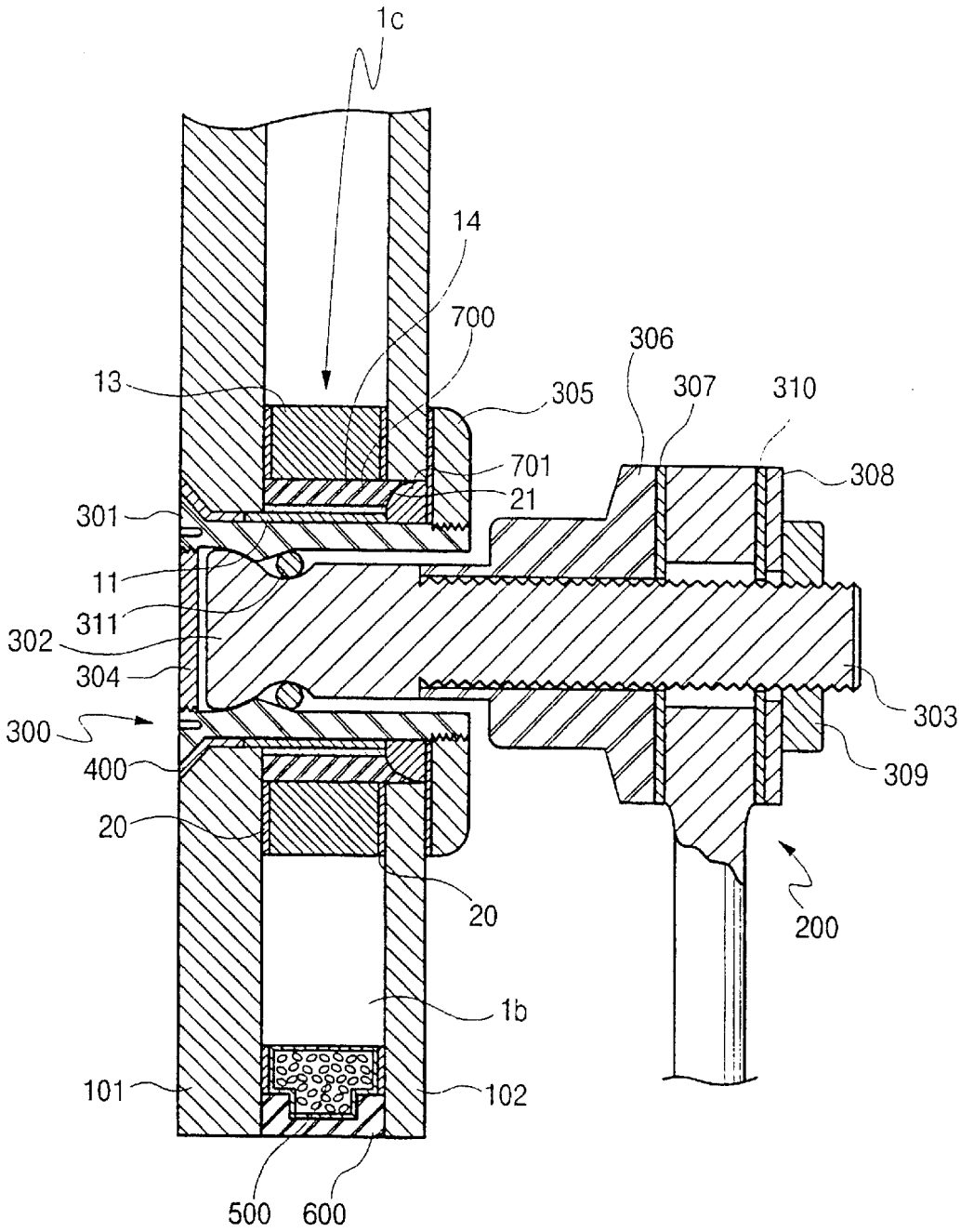
FIG. 14 is a partially sectional view showing in detail a fixing member for fixing to a supporting member another form of the sealed double glazing unit using the sealing member as shown in FIG. 13, according to the invention.

Further, as shown in FIG. 12 to FIG. 14, in still another embodiment of the invention, a boss 13 and a guide ring 11 of the sealing member 1*c* are formed separate, and instead of connecting parts 12 for providing the sealing space 14, a bellows-shaped plate is inserted therebetween, thereby forming the sealing space 14 by providing the plate 15 for the sealing member 1*c*.

Figure 15:
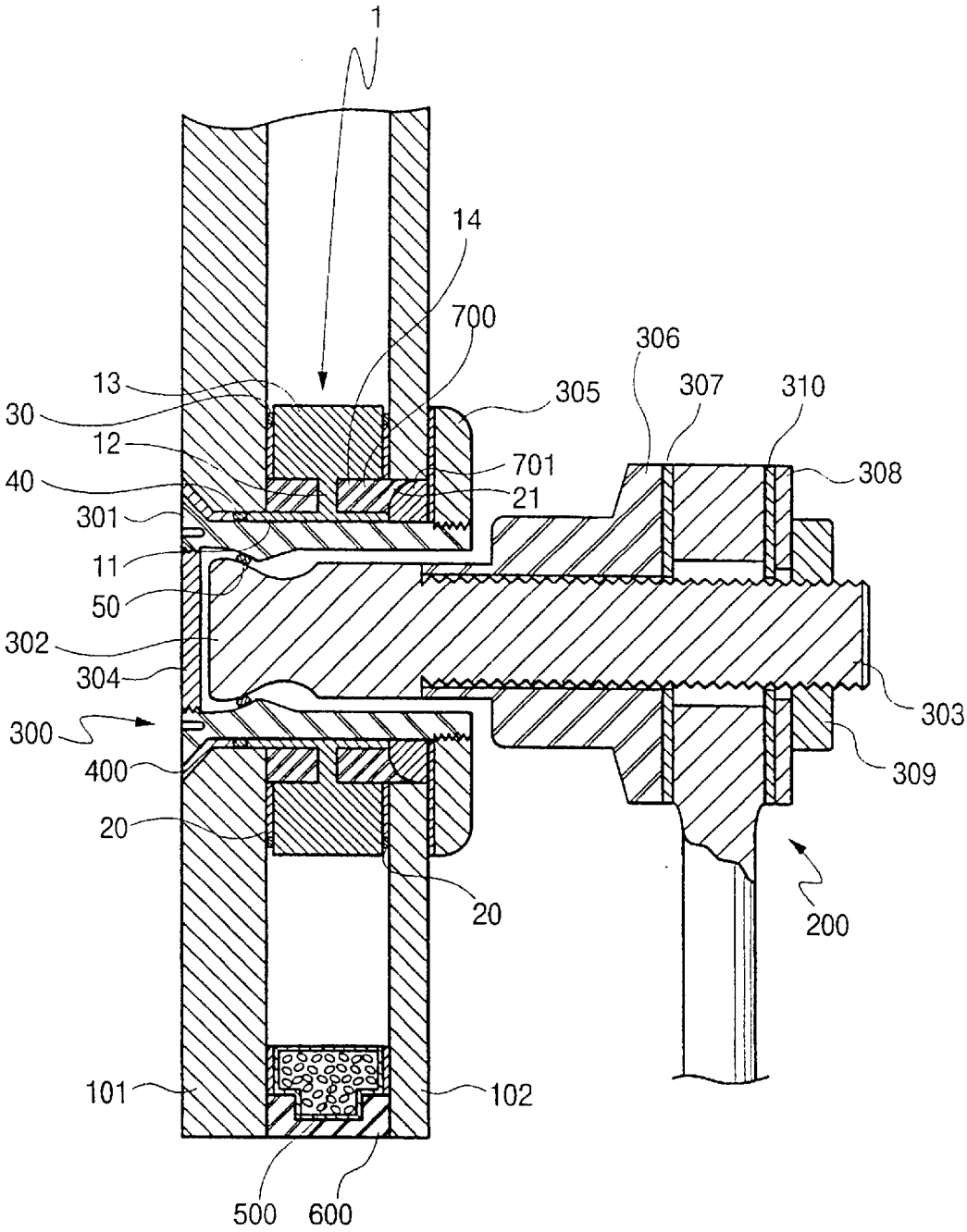
FIG. 15 is a partially sectional view showing in detail a fixing member for fixing to a supporting member another form of the sealed double glazing unit using O-rings according to the invention.

Also, as shown in FIG. 15, for the sake of a moisture-tight and air-tight seals, a pair of O-rings 30 is arranged between the boss 13 of the sealing member and the outer and the inner panes 101,102, one O-ring 40 between the liner 400 and the guide ring 11 of the sealing member 1, and another O-ring 50 between the socket 301 of the fixing member 300 and the hemisphere part 302 at the top of the fixing bolt 303.

The arranging process or sealing process of the above-mentioned sealing member 1*a*, 1*b*, 1*c* is conducted by the same process as that of the sealing member 1.

As set forth above, according to the invention, a seating member having simple structure, and arranged on the coaxial position with the hole in outer pane is provided, the filling of the sealing compound is easy and additional cutting process is unnecessary, thereby improving the productivity and the quality of an sealed double glazing unit.

What is claimed is:

1. A sealed double glazing unit comprising:

an outer pane 101 having a countersunk hole 101' punched in a corner thereof;

an inner pane 102 having a hole 102' punched in a corner thereof, and opposed to the hole 101' in said outer pane, said hole in said inner pane having a larger diameter than that of the hole 101' punched in the outer pane;

a liner 400 inserted into the countersunk hole 101' in the outer pane 101, a bottom of said liner extending into without passing through the hole in the outer pane;

a fixing member 300 fixed through the liner 400 to a supporting member 200 of a wall body of a building;

a sealing member 1 engaging the holes 101', 102' in the outer pane 101 and the inner pane 102 to seal said holes together with a sealing compound, said sealing member including a guide ring having a same diameter as a diameter of the bottom of said liner, a front end of said guide ring extending to and contacting with said bottom of said liner;

a ring-shaped boss 13 concentric with and encircling said guide ring, said ring-shaped boss 13 having an inner diameter larger than an outer diameter of said guide ring 11 such that a space is formed therebetween;

a plurality of connecting parts 12 bridging said space between the outer diameter of said guide ring 11 and the inner diameter of said ring-shaped boss 13; and said supporting member 200 having a hole through which a bolt 303 passes and is fastened with a nut 309.

2. The sealed double glazing unit according to claim 1, wherein an outer peripheral surface of said front end is fitted with the inner peripheral surface of the hole 101' in the outer pane 101, and said ring-shaped boss 13 has a smaller width than a width of the space defined by said inner pane 102 and said outer pane 101.

3. A sealed double glazing unit according to claim 1, wherein the bottom of said liner 400*a* passes through the hole 101' in the outer pane 101 and extends to the vicinity of the hole 102' in the inner pane 102, and said sealing member 1*a* comprises:

a ring-shaped boss 13 having the inner diameter larger than the outer diameter of the liner 400*a* and having smaller width than that of the space defined by said inner pane 102 and said outer pane 101; and a plurality of connecting parts 12, the free ends of which contact with the outer peripheral surface of the liner 400*a*.

4. A sealed double glazing unit according to claim 1, wherein the bottom of a liner 400*a* passes through the hole 101' in the outer pane 101 and extends to the vicinity of the hole 102' in an inner pane 102, and said sealing member 1*b* comprises:

a guide ring 11, the width of which is the same as those of the connecting parts 12 and is smaller than that of the space between the outer pane 101 and the inner pane 102, and inner peripheral surface of the guide ring 11 contacting with the outer peripheral surface of the liner 400*a;* a ring-shaped boss 13 having the inner diameter larger than the outer diameter of the guide ring 11 and having smaller width than that of the space defined by said inner pane 102 and said outer pane 101; and a plurality of connecting parts 12 which bridge said guide ring 11 and said boss 13.

5. A sealed double glazing unit according to claim 1, wherein the bottom of said liner 400 extends without passing through the hole 101' in the outer pane 101, and said sealing member 1*c* comprises:

a guide ring 11 having the same diameter as that of the bottom of the liner 400, a front end of said guide ring 11 extending to and contacting with said bottom of the liner 400, a rear end thereof extending to the vicinity of the inner surface of said inner pane 102, and outer peripheral surface of said front end fitted with the inner peripheral surface of the hole 101' in the outer pane 101;

a ring-shaped boss 13 having the inner diameter larger than the outer diameter of the guide ring 11 and having smaller width than that of the space defined by said inner pane 102 and said outer pane 101; and a bellows-shaped plate 15 intervening between said guide ring 11 and said ring-shaped boss 13.

6. The sealed double glazing unit according claim 1, wherein a first pair of O-rings 30 is arranged between both side of the boss 13 of the sealing member 1 and the outer and the inner pane 101, 102, a second O-ring 40 is arranged between the liner 400 and the guide ring 11 of the sealing member 1, and a third O-ring 50 is arranged between a socket 301 of fixing member 300, and a hemisphere part 302 at ahead of the fixing bolt 303, thereby accomplishing moisture-tight and air-tight seals.

7. A sealed double glazing unit comprising:

an outer pane having a countersunk hole punched in a corner thereof;

an inner pane having a hole punched in a corner thereof, and opposed to the countersunk hole in said outer pane;

a generally cylindrical liner inserted into the countersunk hole in the outer pane, a bottom of said liner extending into, without passing through, the countersunk hole in the outer pane;

a fixing member fixed through the liner for securing the glazing unit to a supporting member;

a sealing member for engaging the holes in the inner and outer panes, said sealing member including a guide ring having a same diameter as a diameter of the bottom of said liner, a front end of said guide ring extending into said countersunk hole and abutting against said bottom of said liner;

a ring-shaped boss concentric with and encircling said guide ring, said ring-shaped boss having an inner diameter larger than an outer diameter of said guide ring such that a space is formed therebetween;

a plurality of connecting parts bridging said space between the outer diameter of said guide ring and the inner diameter of said ring-shaped boss.

8. The sealed double glazing unit according to claim 7, further comprising an O ring inserted between said front end of said guide ring and said bottom of said liner for providing a moisture-tight and air-tight seal therebetween.

9. The sealed double glazing unit according to claim 7, wherein each of said plurality of connecting parts is an elongated member having first and second ends, said first end contacting said guide ring and said second end contacting said ring-shaped boss.

* * * * *